United States Patent [19]

Brewer, Sr.

[11] Patent Number: 4,658,627

[45] Date of Patent: Apr. 21, 1987

[54] INDEPENDENT PULL TOWER FOR VEHICLE FRAME AND BODY STRAIGHTENING APPARATUS

[76] Inventor: Clarence R. Brewer, Sr., P.O. Box 247, Central City, Ky. 42330

[21] Appl. No.: 769,400

[22] Filed: Aug. 26, 1985

[51] Int. Cl.[4] ..... B21D 1/12

[52] U.S. Cl. ..... 72/447; 72/705

[58] Field of Search ..... 72/705, 447

[56] References Cited

U.S. PATENT DOCUMENTS

| | | | |
|---|---|---|---|
| 3,029,859 | 4/1962 | Grant | 72/705 |
| 3,566,666 | 3/1971 | Berendt et al. | 72/705 |
| 3,691,817 | 9/1972 | Friend et al. | 72/705 |
| 3,835,693 | 9/1974 | Majersky | 72/705 |
| 3,888,100 | 6/1975 | Chisum | 72/705 |
| 3,999,419 | 12/1976 | Larson et al. | 72/705 |
| 4,151,737 | 5/1979 | Specktor | 72/705 |
| 4,530,232 | 7/1985 | Smith | 72/705 |
| 4,546,638 | 10/1985 | Field | 72/705 |
| 4,592,225 | 6/1986 | Eck | 72/705 |

*Primary Examiner*—Lowell A. Larson

*Attorney, Agent, or Firm*—Maurice L. Miller, Jr.

[57] ABSTRACT

An independently locatable pull tower used in association with existing vehicle body and frame straightening apparatus where the pull towers are arranged at one end of the platform which receives the damaged vehicle. Straightening is accomplished without the necessity of removing and reversing the damaged vehicle from the apparatus. The additional pull tower is readily positioned for usage, as through wedging action by mechanism on the framework and portions of the platform which receive the damaged vehicle.

Body and frame straightening is accomplished through a pull chain which connects the damaged vehicle and is downwardly displaced by horizontal movement of a powered cylinder. The aforesaid downward displacement is achieved by a receiving member through which the pull chain extends and includes a constricted portion for successive pull chain engagement.

The arrangement also permits vertical adjustment, i.e. the selective positioning of a pull chain receiving collar on the pull tower in accordance with damaged vehicle straightening demands.

11 Claims, 7 Drawing Figures

INDEPENDENT PULL TOWER FOR VEHICLE FRAME AND BODY STRAIGHTENING APPARATUS

As is known, the need for apparatus/equipment for straightening damaged vehicle frames and bodies is widespread, and includes many mechanical approaches for accomplishing such. In this connection, reference is made to the structure described and claimed in the U.S. Chisum Pat. No. Re. 31,636, entitled AUTO BODY AND FRAME STRAIGHTENING DEVICE, where, however, a major deficiency thereof is the provision of several pull towers rotatable to various locations around only one end of the damaged vehicle, i.e. to complete the necessary straightening for most vehicles, the vehicle must be removed from the apparatus and reversed in direction. The preceding results in repair delay and added costs to the vehicle owner.

Accordingly, the invention serves to overcome the aforesaid unhandy, awkward and time consuming procedure in presenting an independent pull tower, selectively usable where an added tower is needed without damaged vehicle repositioning. The instant pull tower is readily maintained in position on existing structure and, additionally, affords effective pull chain tensioning for straightening purposes and ready adaptability to height and directional conditions. Actually, the aforesaid pull chain tensioning and height and directional features are equally appropriate for existing pull towers, i.e. are usable apart from the independent pull tower arrangement which is of significant concern herein.

Briefly, the independent pull tower presented by the invention is carriage mounted and arranged to selectively engage, and be positively positioned, at a preselected location along the platform which customarily receives the damaged vehicle. The pull tower is pivotally secured to the movable carriage for accommodating a particular vehicle straightening condition. A pull-/link chain, secured to the damaged vehicle, is caused to be successively and increasingly tensioned by horizontal movement of a hydraulically operated chain engaging member. In addition to pull tower pivoting, a pulley over which the link chain passes from the damaged vehicle is also pivotal, where, as a further feature, such pulley is vertically movable along the pull tower to satisfy vehicle straightening needs. All of the preceding combine to present a self-contained positively positioned independent pull tower which overcomes any necessity for vehicle relocation on existing apparatus during straightening.

In any event, a better understanding of the present invention would become more apparent from the following description, taken in conjunction with the accompanying drawing, wherein FIG. 1 is a plan view, partly fragmentary, showing a typical installation employing an independent pull tower in accordance with the teachings of the present invention;

Figures 1, 2, 3, 4, 5, 6, 7:
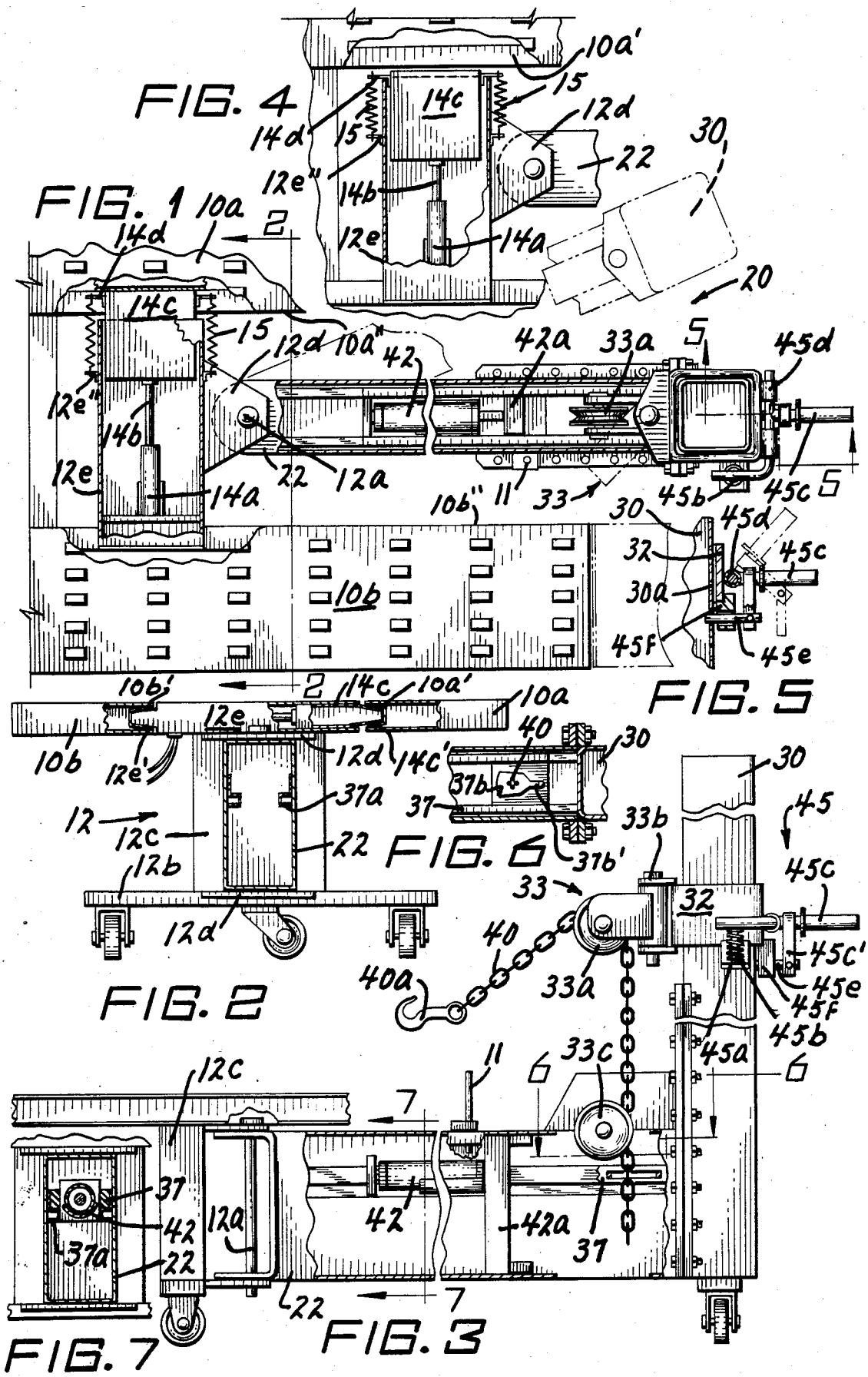
FIG. 2 is a view in elevation detailing the movable carriage for the instant independent pull tower, taken at line 2—2 on FIG. 1 and looking in the direction of the arrows.
FIG. 3 is a view in side elevation, generally comparing to that of FIG. 1 and looking from the bottom to the top thereof, further illustrating the invention.
FIG. 4 is a plan view of the mechanism for positioning the movable carriage, comparing to that of FIG. 1 but before being placed in a fully secured position.
FIG. 5 is a view in vertical section detailing the height or vertical adjustment mechanism forming part of the invention, taken at line 5—5 on FIG. 1 and looking in the direction of the arrows.
FIG. 6 is a plan view detailing the link chain engagement assembly, taken at line 6—6 on FIG. 3 and looking in the direction of the arrows; and, FIG. 7 is another view in vertical section, in this instance taken at line 7—7 on FIG. 3 and looking in the direction of the arrows, showing the power mechanism for the link chain engagement assembly.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the independent pull tower presented by the invention is defined by a movable wheeled carriage 12 to which a pull tower assembly 20 is pivotally secured, at **12*a*. The pull tower assembly 20 is movable, for example, from the full line to the broken line positions of FIG. 1—where the actual location is dependent upon the vehicle area being straightened. An upwardly extending pin 11 (FIGS. 1 and 3**) serves positive placement purposes.

In any event, the movable wheeled carriage 12 is adapted to be placed between platforms or runways **10*a*–10*b*** forming part of customary body and frame straightening apparatus (not shown), but at the end thereof remote from the usual pull towers (also not shown). In this regard, and as stated, the instant pull tower serves an important need in affording straightening force at a location where a pull tower is generally unavailable.

With reference now to FIGS. 1, 2, 3 and 4, the wheeled carriage 12 includes a platform **12*b* mounting an upstanding frame 12*c* from which projections 12*d* extend to receive pivot axle 12*a*, i.e. the pivot for the pull tower assembly 20. As particularly evident in FIGS. 1, 2 and 4, an enclosure 12*e* for positioning mechanism 14 extends laterally of the frame 12*c***.

A hydraulically operated cylinder **14*a*, through rod 14*b*, supports a positioning member 14*c* having a tapered forward end 14*c*′ selectively received in a correspondingly shaped recess 10*a*′ along the inner edge 10*a*″ of runway 10*a* (see FIG. 2). A recess 10*b*′ along inner edge 10*b*″ of runway 10*b* receives a correspondingly shaped portion 12*e*′ of enclosure 12*e*. Thus, the wheeled carriage 12 is positively located, where desired, as is, in turn, the pull tower assembly 20**.

In order to achieve placement of carriage 12, the cylinder **14*a* is actuated, moving the rod 14*b* and positioning member 14*c* forwardly into the wedged position of FIG. 1. As also evident in FIGS. 1 and 2, the assembly includes projections 12*e*″ on opposite sides of the enclosure 12*e*, where spring members 15 extend between such and in-line projections 14*d* on opposite sides of the positioning member 14*c***. The preceding relationship permits the withdrawal of the tapered forward end 14c' of the positioning member 14c from the recess 10a' along the inner edge 10a'' of runway 10a (see FIG. 4) upon deactuation of hydraulic cylinder 14a.

Referring now to FIGS. 1, 3 and 6, the pull tower assembly 20 is defined by an elongated body member 22 supporting, at its outward end, a vertically disposed wheel mounted pull tower 30. The pull tower 30, typically square in horizontal section, receives a vertically slidable collar 32 which mounts a pulley 33a forming part of a pulley assembly 33, pivotal at axle 33b, over which a link chain 40 downwardly passes. The link chain 40 includes a hook 40a at one end for selective engagement with the damaged vehicle, where the other end engages a locating pulley 33c and is received for selective movement in a movable link chain engaging member 37.

Disposed within the body member 22, and fixedly positioned, in part, by an upstanding support 42a is hydraulic cylinder 42 which operatively connects the link chain engaging member 37 for movement along slideways 37a (see FIGS. 2 and 7). As particularly evident in FIG. 6, the link chain 40 passes through an opening 37b in the link chain engaging member 37. When it is desired to tension the link chain 40, i.e. move such downwardly to accomplish vehicle body/frame alignment (also see FIG. 3), the hydraulic cylinder 42 moves the link chain engaging member 37 so that the link chain 40 is caught in a narrowed or constricted portion 37b' at an end of the opening 37b.

In other words, the link chain 40 is latched upon actuation of the hydraulic cylinder 42, and as the link chain member 37 moves from right to left in FIGS. 1 and 3, the link chain 40 moves downwardly, causing the hook 40a, connected to the damaged vehicle, to move so as to achieve body/frame straightening. The preceding is successively repeated as the damaged vehicle condition warrants.

In FIGS. 1, 3 and 5, a mechanism 45 is disclosed for the selective adjustment of collar 32 supporting the pulley assembly 33 at a desired vertically disposed opening 30a in a side wall of tower 30 (see FIG. 5). In this connection, the mechanism 45 includes an angled support 45a secured to the collar 32 which receives or positions a spring member 45b. A control arm 45c is mounted on sleeves 45d secured onto the collar 32 (see FIG. 1). The control arm 45c also includes a fixed support 45c' pivotally mounting a stop pin 45e, where the latter extends through a support block 45f also mounted on the collar 32.

In other words, when the control arm 45c is pivoted upwardly in the sleeves 45d, the stop pin 45e moves outwardly and becomes disengaged from an opening 30a in the side wall of tower 30. The preceding action is against the force of the spring member 45b, i.e. the latter is continually urging the control arm 45c into the latched or pinned position of FIG. 3. Restated otherwise, spring member 45b serves to positively maintain the stop pin 45e in any desired vertical opening 30a in the side wall of tower 30.

FIG. 5 further details the assembly, showing the control arm 45c and the fixed support 45c' in a raised position (in phantom lines) but, for purposes of understanding and/or illustration, the stop pin 45e freely dangles downwardly, i.e. after its removal from the support block 45f and a vertically disposed opening 30a in the wall of the tower 30.

Thus, from the preceding it should be evident that the independent or additional pull tower afforded by the invention is readily adaptable for use with existing body and frame straightening apparatus where the available pull towers are arranged at one end and where damaged vehicle removal and reversal is a necessity to satisfy repair requirements commonly encountered in the trade. Not only is the additional pull tower positively secured in position, but effective tensioning or pull chain results are achieved through selective horizontal movement of a hydraulically actuated pull chain engaging member. Additionally, a pulley assembly slidable on the pull tower may be positioned at a preselected height for an optimum straightening effect, i.e. the pull chain is usable at various levels with respect to the damaged vehicle.

Importantly, the pull chain tension and the height adjustment features are adaptable to various forms of body and frame straightening apparatus apart from the significant independently locatable pull tower presented herein. The described mechanism(s) are susceptible to various changes within the spirit of the invention, including, for example, in proportioning; the specific configuration of the pull chain engaging member; the manner in which the carriage is located in connection with existing body and frame straightening apparatus; height adjustment details; and, the like. Therefore, the preceding description should be considered illustrative and not as limiting the scope of the following claims.

I claim:

1. An independentaly locatable pull tower for use in association with a conventional vehicle frame and body straightening apparatus of the type which includes a damaged vehicle receiving platform and a plurality of movable pull towers arranged on one end portion of same damaged vehicle receiving platform, said independently locatable pull tower comprising a framework removably connectable to and movable independently of said damaged vehicle receiving platform, an additional pull tower mounted on said movable framework, and means for selectively securing said movable framework to said damaged vehicle receiving platform, said means including a powered wedge selectively bearing against portions of said damaged vehicle receiving platform.

2. The independently locatable pull tower of claim 1 wherein said movable framework for said additional pull tower is connectable on an end portion of said damaged vehicle receiving platform opposite the end portion containing said movable towers.

3. The independently locatable pull tower of claim 1 wherein said means includes a hydraulically operated wedge selectively bearing against portions of said damaged vehicle receiving platform.

4. The independently locatable pull tower of claim 1 where said means include a hydraulically operated wedge selectively bearing against one portion of said damaged vehicle receiving platform and an end facing oppositely from said wedge selectively bearing against another portion of said damaged vehicle receiving platform.

5. The independently locatable pull tower of claim 4 where said means extend perpendicularly with respect to the longitudinal axis of said movable framework in a plane containing said damaged vehicle receiving platform.

6. An independently locatable pull tower for use in association with an existing vehicle frame and body straightening apparatus of the type which includes a damaged vehicle receiving platform and a plurality of pull towers arranged on one end portion of said damaged vehicle receiving platform comprising a framework removably connectable to and movable independent of said damaged vehicle receiving platform, an additional pull tower mounted on said movable framework, a collar slidably mounted on said additional pull tower, a pulley connected to said collar for sliding movement therewith, said additional pull tower including vertically spaced openings arranged along a sidewall thereof, a control arm attached to said collar and being pivotal between a first and second position, a stop pin pivotally connected on one end portion thereof to said control arm adapted to be received in one of said openings when said control arm is placed in said first position, said stop pin being retracted from said opening when said arm is in said second position, spring means normally urging said pivotal control arm toward said first position such that said stop pin will be urged into a preselected one of said openings, and means for selectively securing said removably connectable framework to said damaged vehicle receiving platform, said securing means including a powered wedge selectively bearing against portions of said damaged vehicle receiving platform.

7. An independently locatable pull tower for use in association with an existing vehicle frame and body straightening apparatus including a damaged vehicle receiving platform and a plurality of pull towers arranged at one end of said damaged vehicle receiving platform comprising a framework movable independently of said damaged vehicle receiving platform, an additional pull tower mounted on said movable framework, said additional pull tower including vertical openings arranged along a side wall thereof, means selectively securing said movable framework to an end of said existing vehicle frame and body straightening apparatus opposite to said one end thereof, said securing means including a powered wedge selectively bearing against portions of said damaged vehicle receiving platform, a collar including pulley means slidably received on said additional pull tower, chain means connectable to a damaged vehicle disposed on said platform and overlying said pulley means, power means mounted on said movable framework including a member selectively engaging said chain means through generally horizontal movement achieving incremental and successive downward vertical displacement of said chain means and serving damaged vehicle frame and body straightening, and means on said collar selectively cooperable with one of said openings in a height adjustment relationship, said height adjustment means including a pivotal control arm, a stop pin mounted on said pivotal control arm adapted to be received in one of said openings, spring means normally urging said pivotal control arm and said stop pin into a preselected opening.

8. The independently locatable pull tower of claim 7 where said securing means includes a hydraulically operated wedge selectively bearing against one portion of said damaged vehicle receiving platform and an end facing oppositely from said wedge selectively bearing against another portion of said damaged vehicle receiving platform.

9. A pull tower for a vehicle frame and body straightening apparatus of the type which includes a damaged vehicle receiving platform, said pull tower comprising a movable framework, an upstanding tower mounted on said framework, a collar slidably mounted on said upstanding tower, pulley means mounted on said collar, chain means connectable to a damaged vehicle disposed on said platform extending over said pulley means, said pull tower including a plurality of vertically spaced openings arranged along a surface thereof, a control arm attached to said collar and being pivotal between a first and second position, a stop pin pivotally connected on one end portion thereof to said control arm adapted to be received in one of said openings when said control arm is placed in said first position, said stop pin being retracted from said opening when said arm is placed in said second position, spring means normally urging said pivotal control arm toward said first position such that said stop pin will be urged into a preselected one of said openings, and means for selectively securing said movable framework to said damaged vehicle receiving platform, said securing means including a powered wedge selectively bearing against portions of said damaged vehicle receiving platform.

10. The pull tower of claim 9 wherein said pulley means is pivotally connected to said collar for swinging movement through a horizontal arc.

11. The pull tower of claim 10 wherein said upstanding tower is rectangularly shaped as viewed in plan, said collar likewise being of rectangular shape, and said pulley means being pivotally connected to one sidewall of said collar.

* * * * *